US006081178A

United States Patent [19]

Wang et al.

[11] Patent Number: 6,081,178

[45] Date of Patent: Jun. 27, 2000

[54] SUPERCONDUCTIVE MAGNET HAVING A TUBE SUSPENSION ASSEMBLY

[75] Inventors: Yu Wang, Clifton Park; Evangelos Trifon Laskaris, Niskayuna; John Arthur Urbahn, Saratoga Springs, all of N.Y.

[73] Assignee: General Electric Company, Schenectady, N.Y.

[21] Appl. No.: 09/441,172

[22] Filed: Nov. 15, 1999

[51] Int. Cl.[7] ..... H01F 6/00; H01F 6/06

[52] U.S. Cl. ..... 335/216; 335/299; 324/318

[58] Field of Search ..... 335/216, 299; 324/318, 319, 320

[56] References Cited

U.S. PATENT DOCUMENTS 5,530,413 6/1996 Minas et al. ..... 335/216

5,563,566 10/1996 Laskaris et al. ..... 335/216

6,002,315 12/1999 Heiberger et al. ..... 335/216

*Primary Examiner*—Lincoln Donovan

*Assistant Examiner*—Raymond Barrera

*Attorney, Agent, or Firm*—Marvin Snyder; Douglas E. Stoner

[57] ABSTRACT

A superconductive magnet includes a cryogenic vessel enclosing superconductive coils, a thermal shield enclosing the cryogenic vessel, a vacuum enclosure enclosing the thermal shield, a tube suspension assembly having a plurality of tubes located between respective ones of the cryogenic vessel, thermal shield and vacuum enclosure and axially overlapped and interconnected with the cryogenic vessel, thermal shield and vacuum enclosure and the tubes forming bonded joints with one another, and a plurality of locking clip arrangements attached to and having portions at least partially overlapping the bonded joints of the tubes of the suspension assembly so as to reinforce and strengthen the bonded joints.

20 Claims, 4 Drawing Sheets

SUPERCONDUCTIVE MAGNET HAVING A TUBE SUSPENSION ASSEMBLY

BACKGROUND OF THE INVENTION

The present invention generally relates to superconductive magnets and, more particularly, is concerned with a superconductive magnet having a tube suspension assembly.

Superconductive magnets include superconductive coils which generate uniform and high strength magnetic fields, such as used, without limitation, in magnetic resonance imaging (MRI) systems employed in the field of medical diagnostics. The superconductive coils of the magnet typically are enclosed in a cryogenic vessel surrounded by a vacuum enclosure and insulated by a thermal shield interposed therebetween.

Various designs of tube suspension assemblies are employed to support the cryogenic vessel enclosing the superconductive coils of the magnet from and in spaced apart relation to both the thermal shield and the vacuum enclosure of the magnet. As one example, the tube suspension assembly can include overlapped fiberglass outer and inner support cylinders, such as disclosed in U.S. Pat. No. 5,530,413 to Minas et al. which is assigned to the same assignee as the present invention. In the Minas et al. tube suspension assembly, the outer support cylinder is located within and generally spaced apart from the vacuum enclosure and positioned outside of and generally spaced apart from the thermal shield. A first end of the outer support cylinder is rigidly connected to the vacuum enclosure while a second end of the outer support cylinder is rigidly connected to the thermal shield. The inner support cylinder is located within and generally spaced apart from the thermal shield and is positioned outside of and generally spaced apart from the cryogenic vessel. The inner support cylinder has a first end rigidly connected to the thermal shield near the second end of the outer support cylinder and has a second end located longitudinally between the first and second ends of the outer support cylinder and rigidly connected to the cryogenic vessel.

Problems can occur, however, with some designs of tube suspension assemblies at cryogenic temperatures. For instance, tube suspension assemblies of some superconductive magnet designs in MRI systems employ metal alloys or glass-epoxy materials. Metal alloys as well as glass-epoxy materials do not provide optimal load distributing and thermal insulating characteristics. Further, metal alloys are heavy and glass-epoxy materials deform as they tend to be compliant.

More recently, tube suspension assemblies are being developed that employ composite shells made of graphite-epoxy material and assembled together with step joint adhesive bonds to form the assembly. The graphite-epoxy material is stiffer than glass-epoxy material and tends to deform elastically rather than plastically. However, experiments and finite element analyses have shown that adhesively bonded joints will be under significant pealing when an axial load is applied and the step joint under significant rotation. Also tests have shown that adhesive bond strength varies significantly with the surface preparation and bond line thickness and other factors. The strength of the adhesive bond is part of the load path of the suspension system and thus its reliability is a limitation on the load limit of the whole suspension system.

Consequently, a need still exists for innovation with respect to superconductive magnet suspension assemblies which will provide a solution to the aforementioned problems.

BRIEF SUMMARY OF THE INVENTION

The present invention provides a suspension assembly having adhesively bonded joints reinforced with locking clip reinforcement arrangements designed to satisfy the aforementioned need. The locking clip reinforcement arrangements are employed to reinforce the adhesive bonds so as to prevent premature failure of the joints under conditions where the adhesive bonds fail.

In an embodiment of the invention, a tube suspension assembly is provided for superconductive magnets. The superconductive magnet has a central longitudinal axis and includes a cryogenic vessel enclosing superconductive coils, a thermal shield enclosing the cryogenic vessel, a vacuum enclosure enclosing the thermal shield. The cryogenic vessel, thermal shield and vacuum enclosure have annular shapes and are radially spaced apart from one another with reference to the longitudinal axis and coaxially aligned with the longitudinal axis. The tube suspension assembly comprises a plurality of tubes located between respective ones of the cryogenic vessel, thermal shield and vacuum enclosure and axially overlapped and interconnected with the cryogenic vessel, thermal shield and vacuum enclosure, the tubes forming bonded joints with one another, and a plurality of locking clip arrangements attached to and having portions at least partially overlapping the bonded joints of the tubes so as to reinforce and strengthen the bonded joints.

More particularly, the bonded joints are formed by mated and adhesively bonded annularly-shaped steps provided on end portions of the tubes. At least one of the locking clip reinforcement arrangements includes a plurality of generally L-shaped clips spaced apart from one another and mated with and at edge flanges thereon overlapping the bonded joint of one pair of the tubes and a plurality of fasteners attaching the L-shaped clips to one of the tubes of the one pair thereof forming the bonded joint. Also, at least another one of locking clip reinforcement arrangements includes a plurality of generally U-shaped clips spaced apart from one another and mated with and at edge flanges thereon overlapping the bonded joint of another pair of the tubes of the suspension assembly.

DETAILED DESCRIPTION OF THE INVENTION

Figure 1:
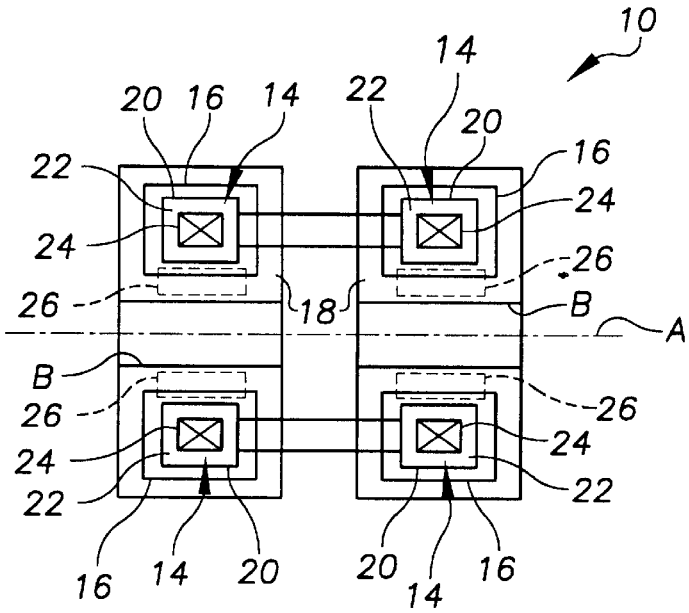
FIG. 1 is a schematic side elevational view of an MRI superconductive magnet in which a locking clip reinforcement arrangement of the present invention can be employed.

Referring now to the drawings and particularly to FIG. 1, there is schematically illustrated an open magnetic resonance imaging (MRI) superconductive magnet, generally designated 10, for employing the locking clip reinforcement arrangements 12*a*, 12*b* (see FIGS. 3–12) of the present invention. The MRI superconductive magnet 10 has a centrally-located longitudinal axis A and includes a superconductive coil assembly 14 at cryogenic temperature, a thermal shield 16 enclosing the superconductive coil assembly 14 and a vacuum enclosure 18 at ambient temperature enclosing the thermal shield 16. The superconductive coil assembly 14, thermal shield 16 and vacuum enclosure 18 are radially spaced from one another with reference to the longitudinal axis A and are coaxially aligned with the longitudinal axis A. Further, the superconductive coil assembly 14 includes a cryogenic vessel 20 containing a cryogenic fluid 22 and superconductive coils 24. The vacuum enclosure 18 has a pair of spaced central bores B aligned with one another along the longitudinal axis A. The vacuum enclosure 18, thermal shield 16 and cryogenic vessel 20 are in the form of tubular shells of annularly cylindrical configurations.

An example of an open-type MRI magnet is shown and described in greater detail in U.S. Pat. No. 5,563,566 to Laskaris et al which is assigned to the same assignee as the present invention. While the locking clip reinforcement arrangement 12 herein is shown and described in conjunction with the open-type MRI magnet 10, it is equally adapted for use in conjunction with a closed-type MRI magnet, an example of which is found in aforecited U.S. Pat. No. 5,530,413.

Figure 2:
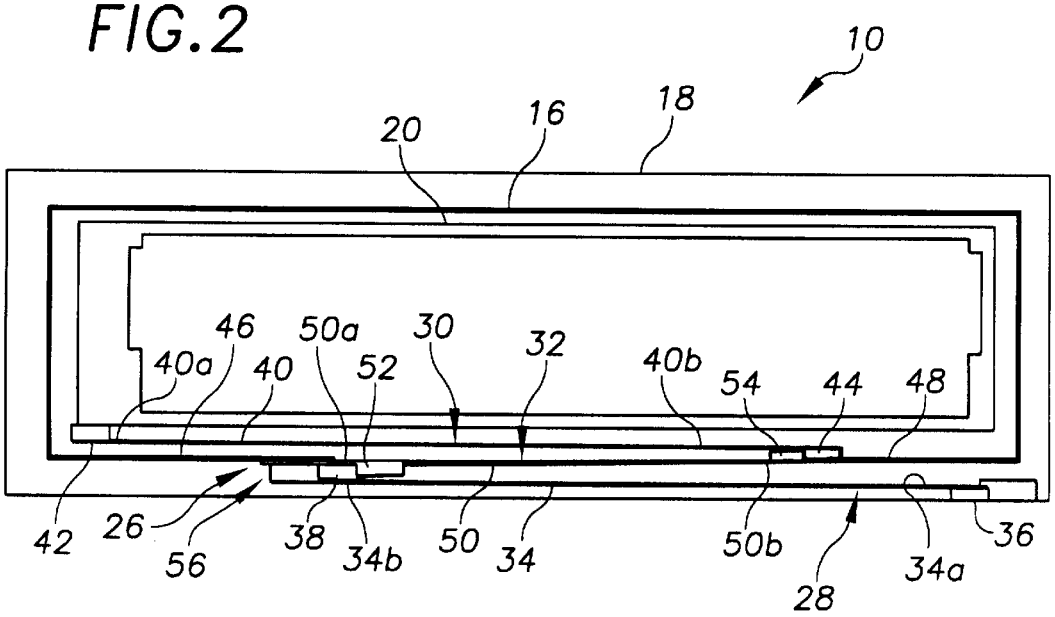
FIG. 2 is a schematic fragmentary view of the upper left portion of the superconductive magnet of FIG. 1 showing a tube suspension assembly employed in the superconductive magnet and having tubes connected by bonded joints with which the locking clip reinforcement arrangement can be employed.

Referring to FIG. 2, there is illustrated in schematical form a tube suspension assembly, generally designated 26, of the MRI superconductive magnet 10 employed between the cryogenic vessel 20, thermal shield 16 and vacuum enclosure 18. The tube suspension assembly 26 includes a plurality of tubes, namely, an inner tube 28, an outer tube 30 and a middle tube 32, interconnected to and axially overlapped with each other and substantially concentrically arranged with one another and with the longitudinal central axis A of the magnet 10. Each of the concentric inner, outer and middle tubes 28, 30, 32 is preferably made of a suitable fiber reinforced composite material.

The inner tube 28 of the tube suspension assembly 26 is located between the vacuum enclosure 18 and thermal shield 16 and interconnects the vacuum enclosure 18 with the middle tube 32. More particularly, the inner tube 28 has a shell-like body 34 of generally conical configuration and interior and exterior annular-shaped steps 36, 38 formed on and protruding radially from opposite first and second end portions 34*a*, 34*b* of the body 34. The interior annular-shaped step 36 provided at the first end portion 34*a* of the body 34 of the inner tube 28 is connected to the vacuum enclosure 18. The exterior annular-shaped step 38 provided at the second end portion 34*b* of the body 34 of the inner tube 28 is adhesively bonded to the middle tube 32.

The outer tube 30 of the tube suspension assembly 26 is located between the thermal shield 16 and the cryogenic vessel 20 of the superconductive coil assembly 14 and interconnects the middle tube 32 with the cryogenic vessel 20. The outer tube 30, more particularly, has a shell-like body 40 of generally conical configuration and external and internal annular-shaped steps 42, 44 formed on and protruding radially from the opposite first and second end portions 40*a*, 40*b* of the body 40. The external annular-shaped step 42 of the body 40 of the outer tube 30 at the first end portion 40*a* thereof is connected to the cryogenic vessel 20.

The thermal shield 16 is provided in the form of separate, axially displaced and overlapped, inner and outer shell portions 46, 48. The middle tube 32 of the tube suspension assembly 26 is located between and overlapped with the inner and outer shells 46, 48 of the thermal shield 16 and interconnects therewith and also interconnects the inner tube 28 with the outer tube 30. More particularly, the middle tube 32 has a generally shell-like body 50 of substantially cylindrical configuration and interior and exterior annular-shaped steps 52, 54 formed on and projecting radially from opposite first and second end portions 50*a*, 50*b* of the body 50 of the middle tube 32. The interior step 52 of the middle tube 30 is disposed adjacent to and adhesively bonded with the exterior annular-shaped step 38 of the inner tube 28. The internal annular-shaped step 44 of the outer tube 30 is disposed adjacent to and adhesively bonded with the exterior annular-shaped step 54 of the middle tube 32.

The characterization of the tubes 28, 30 of the tube suspension assembly 26 and the shell portions 46, 48 of the thermal shield 16 respectively as "inner" and "outer" is only because of their relative radial positions with respect to the longitudinal axis A of the magnet 10 in the arrangement illustrated in the drawings wherein the tube suspension assembly 26 is employed between the radially inner walls of the vacuum enclosure 18, thermal shield 16 and cryogenic vessel 20. When the tube suspension assembly 26 is employed between the radially outer walls of the vacuum enclosure 18, thermal shield 16 and cryogenic vessel 20, the relative radial positions of the tubes 28, 30 of the tube suspension assembly 26 and the shell portions 46, 48 the thermal shield 16 with respect to the longitudinal axis A would be reversed and they would then be characterized as the "outer" and "inner" respectively.

Figure 3:
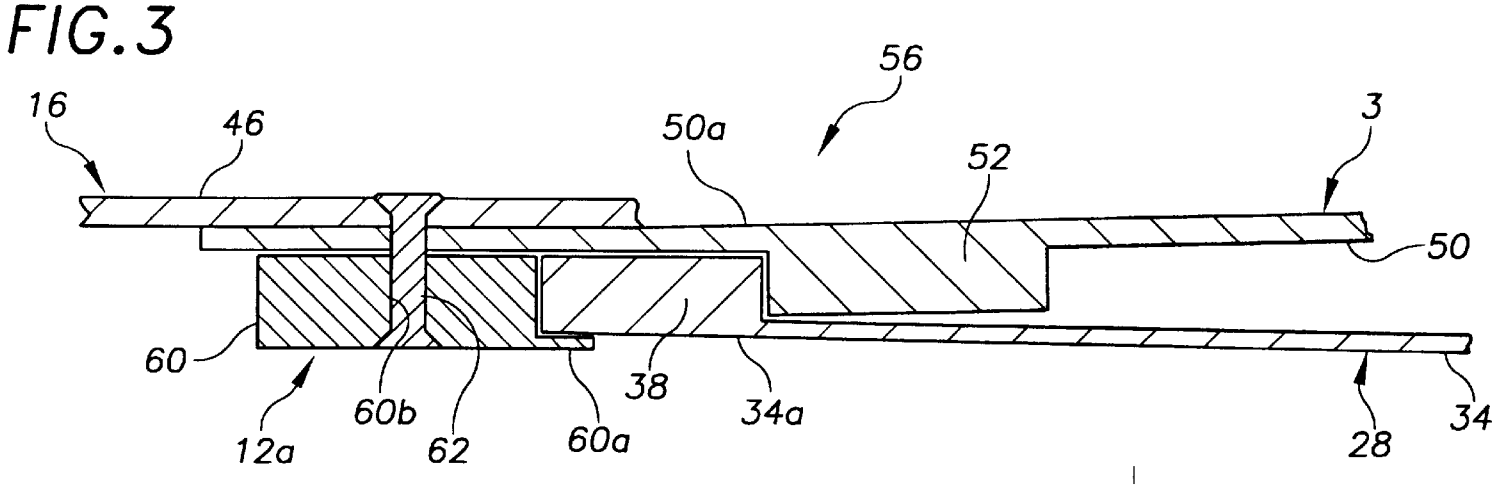
FIG. 3 is an enlarged cross-sectional view of a first embodiment of the locking clip reinforcement arrangement of the present invention for reinforcing the bonded joint between inner and middle tubes of the suspension assembly of FIG. 2.
Figure 5:
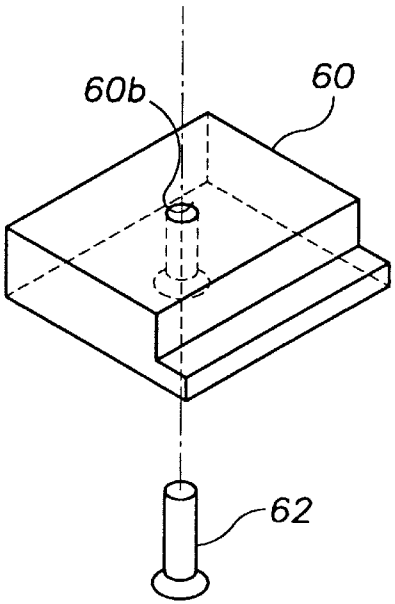
FIG. 5 is a perspective view of a generally L-shaped locking clip and a fastener employed in the first embodiment of the locking clip reinforcement arrangement of FIG. 3.
Figure 4:
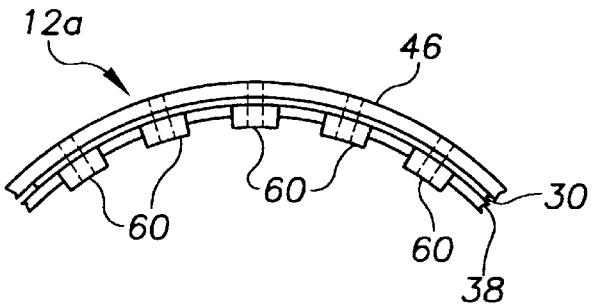
FIG. 4 is a fragmentary end elevational view of the locking clip reinforcement arrangement of FIG. 3.
Figure 7:
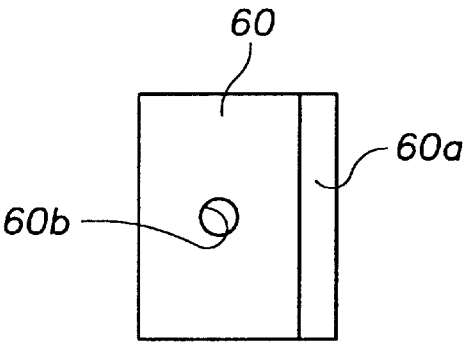
FIG. 7 is a plan view of the locking clip as seen along line 7—7 of FIG. 6.
Figure 6:
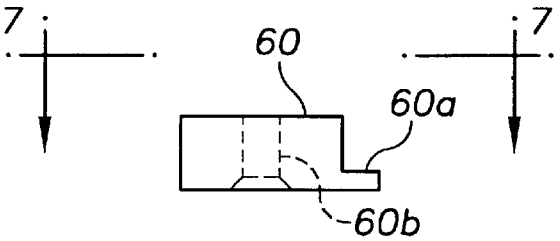
FIG. 6 is an end elevational view of the locking clip of FIG. 5.
Figure 8:
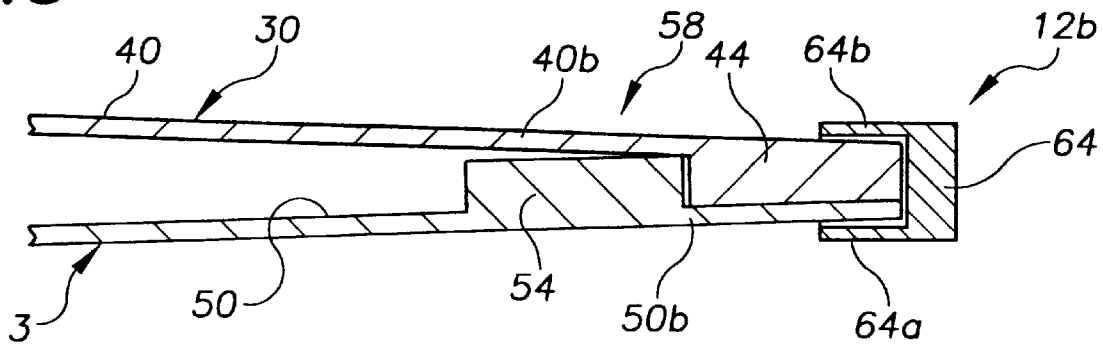
FIG. 8 is an enlarged cross-sectional view of a second embodiment of the locking clip reinforcement arrangement of the present invention for reinforcing the bonded joint between outer and middle tubes of the suspension assembly of FIG. 2.
Figure 10:
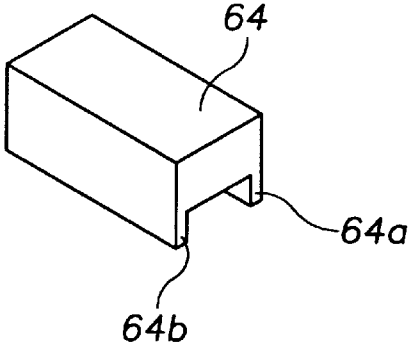
FIG. 10 is a perspective view of a generally U-shaped locking clip employed in the second embodiment of the locking clip reinforcement arrangement of FIG. 8.
Figure 12:
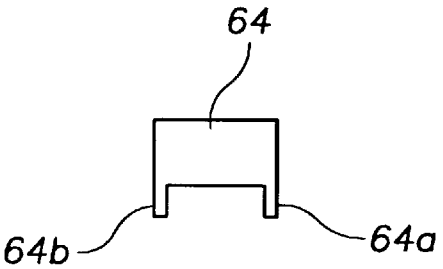
FIG. 12 is an end elevational view of the locking clip as seen along line 12—12 of FIG. 11.
Figure 9:
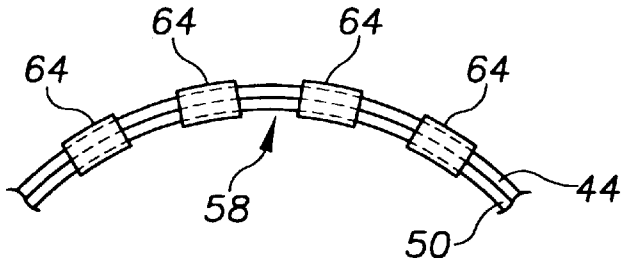
FIG. 9 is a fragmentary end elevational view of the locking clip reinforcement arrangement of FIG. 8.
Figure 11:
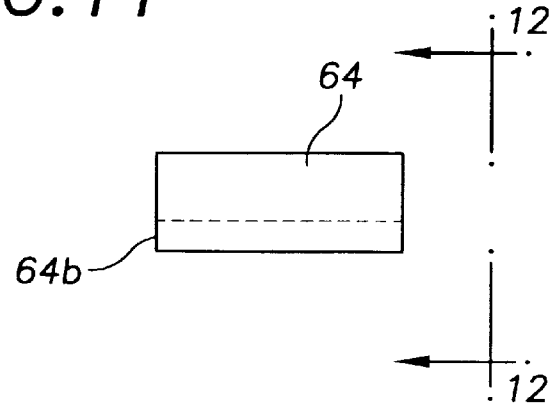
FIG. 11 is a side elevational view of the locking clip of FIG. 10.

Referring to FIGS. 3 and 8, from the above description of the inner, outer and middle tubes 28, 30, 32 of the tube suspension assembly 26, it can be readily understood that pairs of the tubes 28, 30, 32 define first and second adhesively bonded joints 56, 58. The first and second bonded joints 56, 58 are respectively formed by annularly-shaped steps 38, 44 on the second end portions 34*b*, 40*b* of the bodies 34, 40 of the inner and outer tubes 28, 30 mated and adhesively-bonded with the annularly-shaped steps 52, 54 on the first and second end portions 50*a*, 50*b* of the body 50 of the middle tube 32 of the suspension assembly 26.

Referring now to FIGS. 3 to 7, there is illustrated a first embodiment of the locking clip reinforcement arrangements, generally designated 12*a*. The reinforcement arrangement 12*a* includes a plurality of generally L-shaped clips 60 spaced apart from one another and mated with and at an edge flange 60*a* on each of the L-shaped clips 60 at least partially overlapping the first adhesively-bonded joint 56 formed by the steps 38, 52 provided on the inner and middle tubes 28, 32 of the suspension assembly 26. The reinforcement arrangement 12*a* also includes a plurality of fasteners 62, such as rivets, each received through a hole 60*b* in one of the L-shaped clips 60 and attaching the one L-shaped clip 60 to the middle tube 32 and inner shell portion 46 of the thermal shield 16.

Referring now to FIGS. 8 to 12, there is illustrated a second embodiment of the locking clip reinforcement arrangement, generally designated 12*b*. The reinforcement arrangement 12*b* includes a plurality of generally U-shaped clips 64 spaced apart from one another and mated with and at opposite edge flanges 64*a*, 64*b* on each of the U-shaped clips 64 at least partially overlapping the second adhesively-bonded joint 58 formed by the steps 44, 54 provided on the outer and middle tubes 30, 32 of the suspension assembly 26. The U-shaped clips 64 either just frictionally interfit with the second bonded joint 58 or alternatively is also adhesively bonded thereto. The L-shaped clips 60 and U-shaped clips 64 can be made from a low-cost extruded aluminum material.

It is thought that the present invention and its advantages will be understood from the foregoing description and it will be apparent that various changes may be made thereto without departing from the spirit and scope of the invention or sacrificing all of its material advantages, the above-described embodiment(s) being merely exemplary thereof.

What is claimed is:

1. A superconductive magnet, comprising:

a superconductive coil assembly having a cryogenic vessel;

a thermal shield enclosing said cryogenic vessel;

a vacuum enclosure enclosing said thermal shield;

a tube suspension assembly having a plurality of tubes located between respective ones of said cryogenic vessel, thermal shield and vacuum enclosure and axially overlapped and interconnected with said cryogenic vessel, thermal shield and vacuum enclosure, said tubes forming bonded joints with one another; and a plurality of locking clip reinforcement arrangements attached to and having portions at least partially overlapping said bonded joints of said tubes of said suspension assembly so as to reinforce and strengthen said bonded joints.

2. The magnet of claim 1 in which at least one of said locking clip reinforcement arrangements includes a plurality of generally L-shaped clips spaced apart from one another and mated with and at edge flanges thereon at least partially overlapping said bonded joint formed by a pair of said tubes of said tube suspension assembly.

3. The magnet of claim 2 in which said bonded joint is formed by mated and adhesively bonded annularly-shaped steps provided on end portions of said pair of said tubes.

4. The magnet of claim 2 in which said at least one of said locking clip reinforcement arrangements further includes a plurality of fasteners attaching said L-shaped clips to one of said tubes of said tube suspension assembly forming said bonded joint.

5. The magnet of claim 1 in which at least one of said locking clip reinforcement arrangements includes a plurality of generally U-shaped clips spaced apart from one another and mated with and at edge flanges thereon at least partially overlapping said bonded joint formed by one pair of said tubes of said tube suspension assembly.

6. The magnet of claim 5 in which said bonded joint is formed by mated and adhesively bonded annularly-shaped steps provided on end portions of said one pair of said tubes.

7. The magnet of claim 5 in which at least another one of said locking clip reinforcement arrangements includes a plurality of generally L-shaped clips spaced apart from one another and mated with and at edge flanges thereon at least partially overlapping said bonded joint formed by another pair of said tubes of said tube suspension assembly.

8. The magnet of claim 7 in which said at least another one of said locking clip reinforcement arrangements further includes a plurality of fasteners attaching said L-shaped clips to one of said tubes of said tube suspension assembly.

9. The magnet of claim 1 in which said cryogenic vessel, thermal shield and vacuum enclosure have annular shells radially spaced apart from one another with reference to a common longitudinal axis and coaxially aligned with said common longitudinal axis.

10. The magnet of claim 1 in which said tubes are composite shells.

11. A superconductive magnet, comprising:

a superconductive coil assembly having a cryogenic vessel;

a thermal shield enclosing said cryogenic vessel and having axially displaced inner and outer shell portions;

a vacuum enclosure enclosing said thermal shield;

a tube suspension assembly including an inner tube having opposite first and second end portions and being axially overlapped with and disposed between said vacuum enclosure and said thermal shield and connected at said first end portion to said vacuum enclosure, an outer tube having opposite first and second end portions and being axially overlapped with and disposed between said cryogenic vessel and said thermal shield and connected at said first end portion to said cryogenic vessel, and a middle tube having opposite first and second end portions and being axially overlapped with and disposed between and connected to said inner and outer shell portions of said thermal shield, said opposite first and second end portions of said middle tube also forming first and second bonded joints with said respective second end portions of said inner and outer tubes; and a plurality of locking clip reinforcement arrangements attached to and having portions at last partially overlapping said first and second bonded joints of said inner, outer and middle tubes of said suspension assembly so as to reinforce and strengthen said first and second bonded joints.

12. The magnet of claim 11 in which at least one of said locking clip reinforcement arrangements includes a plurality of generally L-shaped clips spaced apart from one another and mated with and at edge flanges thereon overlapping said first bonded joint formed by said inner and middle tubes of said tube suspension assembly.

13. The magnet of claim 12 in which said first bonded joint of said inner and middle tubes is formed by mated and adhesively bonded annularly-shaped steps provided on respective second and first end portions of said inner and middle tubes.

14. The magnet of claim 12 in which said at least one of said locking clip reinforcement arrangements further includes a plurality of fasteners attaching said L-shaped clips to said middle tube of said tube suspension assembly.

15. The magnet of claim 11 in which at least one of said locking clip reinforcement arrangements includes a plurality of generally U-shaped clips spaced apart from one another and mated with and at opposite end flanges thereon overlapping said second bonded joint formed by said outer and middle tubes of said tube suspension assembly.

16. The magnet of claim 15 in which said second bonded joint of said outer and middle tubes is formed by mated and adhesively bonded annularly-shaped steps provided on said respective second end portions of said outer and middle tubes.

17. The magnet of claim 15 in which at least another one of said locking clip reinforcement arrangements includes a plurality of generally L-shaped clips spaced apart from one another and mated with and at edge flanges thereon overlapping said first bonded joint formed by said inner and middle tubes of said tube suspension assembly.

18. The magnet of claim 17 in which said at least another one of said locking clip reinforcement arrangements further includes a plurality of fasteners attaching said L-shaped clips to said middle tube of said tube suspension assembly.

19. The magnet of claim 11 in which said cryogenic vessel, thermal shield and vacuum enclosure have annular shells radially spaced apart from one another with reference to a common longitudinal axis and coaxially aligned with said common longitudinal axis.

20. The magnet of claim 11 in which said tubes are composite shells.

* * * * *